United States Patent [19]

Brox

[11] Patent Number: 5,023,593

[45] Date of Patent: Jun. 11, 1991

[54] PASSIVE INFRARED/ACOUSTIC POOL SECURITY SYSTEM

[76] Inventor: Steven E. Brox, 5246 E. Glencove Cir., Mesa, Ariz. 85205

[21] Appl. No.: 632,625

[22] Filed: Dec. 26, 1990

Related U.S. Application Data

[63] Continuation of Ser. No. 569,211, Aug. 20, 1990, abandoned, which is a continuation of Ser. No. 336,140, Apr. 11, 1989, abandoned.

[51] Int. Cl.[5] ..... G08B 21/00; G08B 13/18

[52] U.S. Cl. ..... 340/522; 340/540; 340/566; 340/567

[58] Field of Search ..... 340/522, 566, 567, 540

[56] References Cited

U.S. PATENT DOCUMENTS

| | | | |
|---|---|---|---|
| 3,486,166 | 12/1969 | Campana et al. | 340/566 |
| 4,604,610 | 8/1986 | Baker et al. | 340/566 |
| 4,660,024 | 4/1987 | McMaster | 340/522 |
| 4,853,691 | 8/1989 | Kolbatz | 340/566 |

*Primary Examiner*—Glen R. Swann, III

*Attorney, Agent, or Firm*—Cahill, Sutton & Thomas

[57] ABSTRACT

A pool security system incorporates a passive infrared element and an underwater acoustic element. The passive infrared detection element generates a thin infrared layer which overlays the entire water surface area of the pool. As a heat generating body passes through the infrared layer, the infrared element detects the body and generates a first detect signal. As the body enters the water, it causes waves which propagate through the water. These waves are detected by the acoustic element. The acoustic element continues to receive waves generated as the body struggles at or below the water surface. A master control circuit is coupled to the infrared and the acoustic elements to receive the first and second detect signals. The master control circuit is designed to detect when the first detect signal is received, followed a predetermined time by the second detect signal. When this occurs, the master control circuit will generate an alarm signal, thus alerting others of the danger of unauthorized entry.

7 Claims, 1 Drawing Sheet

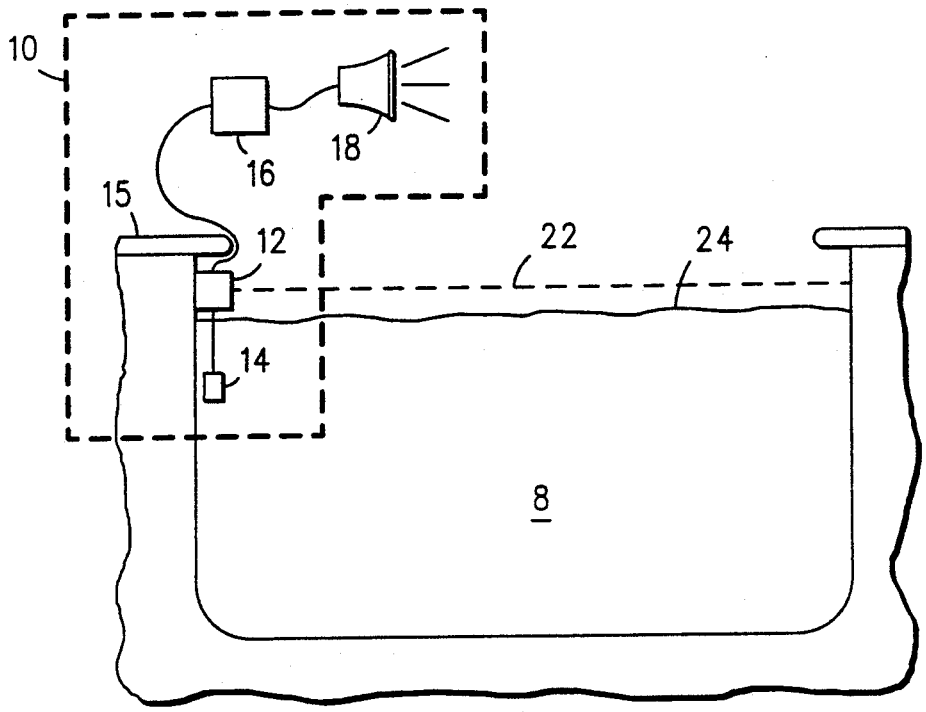
FIG. 1
FIG. 2
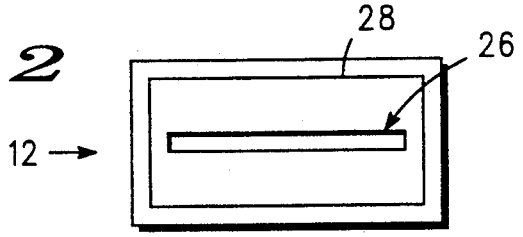
FIG. 3
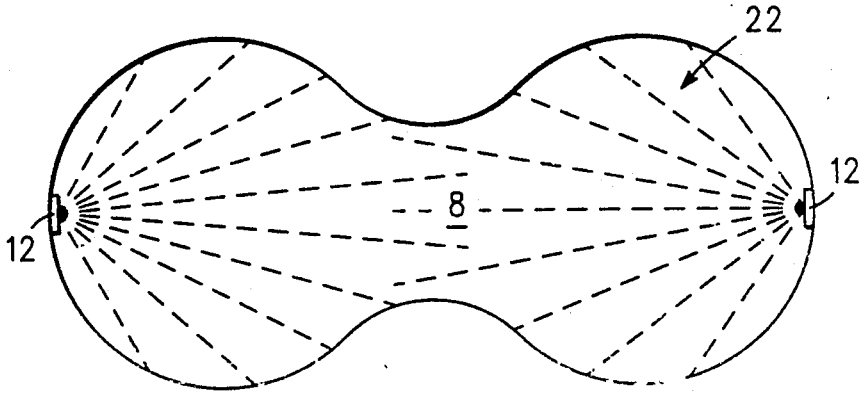

PASSIVE INFRARED/ACOUSTIC POOL SECURITY SYSTEM

This application is a continuation of application Ser. No. 07/569,211, now abandoned, filed Aug. 20, 1990, which is a continuation of prior application Ser. No. 07/336,140, filed Apr. 11, 1989, now abandoned.

BACKGROUND OF THE INVENTION

This invention relates generally to security alarm systems, and more specifically, to security alarm systems for swimming pools and other contained bodies of liquid.

The number of drowning incidents in private swimming pools in the United States has reached tragic proportions in recent years. Drowning is particularly prevalent among young children who do not know how to swim, or are not capable of getting out of pools under emergency or accidental situations. Statistics show that about 3 to 5 children drown in private swimming pools each day.

Alarm systems designed for pools generally fall within three categories. The first category includes sensors activated by surface wave motion. Surface sensors comprise elements such as floatation devices. A major problem with floatation devices is the devices can be activated by wind or inanimate objects falling into the pool. Furthermore, floatation devices may be accidentally triggered by pool cleaning systems.

A second category includes hydrophones which detects splashing noises. A significant problem associated with hydrophones is that hydrophones can be activated with loud or low flying aircraft.

The third major category includes transducers secured below the pool's water surface. The transducers are activated when an object falling into the pool creates wave motions which propagate through the water. A problem with transducers, as with the other types of conventional security systems, is the sensor cannot distinguish a child from an inanimate object.

Attempts have been made to combine transducers, or the other types of conventional security systems, with other sensing devices. These have met with limited to poor success as evidenced by the lack of reliable pool security systems to date.

SUMMARY OF THE INVENTION

Accordingly, it is an object of the present invention to provide a pool security system which distinguishes animate objects from inanimate objects that fall into pools.

Another object of the present invention is to provide a pool security system which incorporates a passive infrared element and an acoustic element to substantially decrease the occurrence of false alarms.

To achieve the above objects of the present invention, a pool security system is disclosed which incorporates a passive infrared element and an underwater acoustic element. The passive infrared element generates a thin infrared layer which overlays the entire water surface area of the pool. As a heat generating body passes through the infrared layer, the infrared element detects the body due to changes in heat and generates a first detect signal. As the body enters the water, it causes waves which propagate through the water. These waves are detected by the acoustic element. The acoustic element continues to detect the waves generated as the body struggles at or below the water and the acoustic element generates a second detect signal. A master control circuit is coupled to the infrared and the acoustic elements to receive the first and second detect signals. The master control circuit is designed to detect when the first detect signal is received, followed a predetermined time by the second detect signal. When this occurs, the master control circuit will generate an alarm signal, thus alerting others of the danger of unauthorized entry.

These and other objects of the present invention will become apparent from the following detailed description of the invention when considered in conjunction with the accompanying drawings.

DESCRIPTION OF THE DRAWINGS

FIG. 1 shows the various elements of an infrared/acoustic devise installed on a pool according to the present invention.

FIG. 2 shows a front view of the passive infrared element according to the present invention.

FIG. 3 shows a pool surface overlaid by a passive infrared detection layer generated by the present invention.

DETAILED DESCRIPTION OF THE INVENTION

Referring to FIG. 1, a pool 8 is shown having an infrared/acoustic pool security system 10 that sounds an alarm when a child, pet, or other animate body has entered the pool uninvited or fallen into the pool accidentally. Infrared/acoustic pool security system 10 comprises infrared element 12, acoustic element 14, control circuit 16, and alarm mechanism 18.

Infrared element 12 creates a passive infrared detection layer 22 above the water surface 24 of pool 8. Infrared element 12 is secured to the edge of pool 8 a predetermined height above water surface 24. Positioning infrared element 12 above water surface 24 prevents wave action of water surface 24 from interfering or communicating with passive infrared detection layer 22. In its preferred embodiment, infrared element 12 is also positioned below deck 15 of pool 8. With infrared element 12 positioned below deck 15 passive infrared detection layer 22 is confined within the area of the pool as defined by deck 15.

FIG. 2 shows a front view of infrared element 12 comprising a narrow, elongated lens 26. Elongated lens 26 reaches horizontally across the front of infrared element 12. Infrared element 12 is secured to pool 8 of FIG. 1 such that an axis of the length of elongated lens 26 is generally parallel with water surface 24. Elongated lens 26 is sealed within water-proof housing 28 of infrared element 12.

Accuracy during installation of infrared element 12 is necessary for the proper orientation of passive infrared detection layer 22. Referring again to FIG. 1, infrared element 12 must be installed so that passive infrared blanket 22 is horizontal with water surface 24. A deviation of approximately six inches from horizontal over a span of sixty feet is considered a reasonable tolerance.

Elongated lens 26 of FIG. 2 can be constructed to radiate passive infrared detection layer 22 over a spectrum of 180 degrees horizontal as shown in FIG. 3. However, many pools are not circular or rectangular. A single infrared element 12 cannot radiate passive infrared detection layer 22 over the entire surface area of water surface 24. Various blind spots would occur. To alleviate the blind spots, more than one infrared element 12 may be incorporated. Each infrared element 12 would be secured to pool 8 in a particular location, depending upon the shape of pool 8, to cover the entire surface area of water surface 2. Positioning two infrared elements 12 across the peanut shaped pool 8 of FIG. 3 eliminates blind spots of passive infrared detection layer 22.

Infrared element 12 may be secured to the top of deck 15. This positioning of infrared element 12 allows passive infrared detection layer 22 to cover a much larger area. The positioning further prevents elongated lens 26 from becoming spotted from water splashing on infrared element 12. However, allowing passive infrared detection 22 layer to radiate unbounded increases the probability of false alarms of infrared/acoustic pool security system 10. For instance, a cat passing across deck 15 could activate infrared element 12. Therefore, infrared element 12 is preferably positioned such that passive infrared detection layer 22 is bounded by deck 15. By positioning infrared element 12 high enough up the side of pool 8, yet below deck 15, contact of elongated lens 26 of FIG. 2 with water from pool 8 can be substantially reduced. Furthermore, elongated lens 26 may be chemically treated to prevent water spotting. Frequent visual inspection and cleaning of elongated lens 26 can also avoid spot interference with passive infrared detection layer 22.

Infrared element 12 detects a heat emitting body as it passes through passive detection layer 22. In fact, infrared element 12 may be designed to detect changes of heat within a single heat emitting body as the body passes through passive infrared detection layer 22. Therefore, when an animate body passes through passive infrared detection layer 22, infrared element 12 detects the change in heat due to the body and generates an infrared detect signal.

Acoustic element 14 preferably comprises a transducer secured underneath water surface 24 of pool 8. Acoustic element 14 detects wave motions propagating through the water of pool 8. Since air movement at water surface 24 can generate wave motions through the water, acoustic element 14 can be adjusted to detect wave motions of predetermined magnitudes. Acoustic element 14 can also be positioned within pool 8 to detect specific wave propagation such as vertical rather than horizontal waves. Acoustic element 14 can further be adjusted to distinguish waves generated by pool cleaning systems from waves generated by a struggling child.

When an animate body enters pool 8, acoustic element 14 detects wave propagation generated by the animate body, and generates an acoustic detect signal.

It should be understood that various types of transducers may be used for acoustic element 14. For instance, underwater microphones may be utilized as well as more advanced, specially designed transducers.

Infrared element 12 and acoustic element 14 are coupled to control circuit 16. The infrared detect signal from infrared element 12, and the acoustic detect signal from acoustic element 14 are relayed to control circuit 16. In the preferred embodiment, control circuit 16 generates an alarm when the infrared and acoustic detect signals are receive by control circuit 16 in a predetermined sequence.

When a child falls into pool 8, the child will first pass through passive infrared detection layer 22. The infrared detect signal is generated and relayed to control circuit 16. The child then enters the water and begins to struggle. Acoustic element 14 detects the waves propagated through the water and generates the acoustic detect signal. The acoustic detect signal is then relayed to control circuit 16. If the acoustic detect signal is receive by control circuit 16 a predetermined time after infrared detect signal is received by control circuit 16, an alarm is generated. The alarm is illustrated by alarm 18 of FIG. 1.

Combining infrared element 12 and acoustic element 14 substantially reduces false alarms. For instance, if only acoustic element 14 is used, any number of inanimate objects falling into pool 8 would cause alarm 18 to be activated. Similarly, infrared element 12, by itself, could cause far more false alarms than the combination of infrared element 12 and acoustic element 14 with the timing of control circuit 16. However, use of infrared element 12 by itself would result in fewer false alarms than use of acoustic element 14 by itself.

Thus, there has been described a passive infrared/acoustic pool security system which meets all the objects, aims, and advantages of the present invention. Although the invention has been specifically described in terms of specific embodiments, other alternatives, variations, and modifications are embraced within the spirit and broad scope of the appended claims.

I claim:

1. A security system for detecting the entry of a heat-emitting body into a defined liquid pool and producing an alarm, said system comprising in combination:

(a) an alarm;

(b) at least one infrared sensor to detect said body in proximity to the surface of said pool and to generate a first signal in response thereto;

(c) at last one transducer to detect waves produced by said body at or below sonic frequencies and to generate a second signal in response thereto;

(d) a controller to receive said first and second signals and activate said alarm in response thereto.

2. The security system of claim 1, wherein said controller activates said alarm only when the second signal is received within a predetermined time after the first signal.

3. A security system for detecting the entry of a heat emitting body into a defined liquid pool and producing an alarm, said system comprising in combination:

(a) alarm means for generating a perceivable alarm;

(b) control means for selectively activating said alarm means;

(c) infrared means for detection the presence of said body in proximity to the surface of said pool and for sending a signal to said control means after said body has been detected; and (d) transducer means for detecting wave motions produced by said body and propagated through the liquid in said pool and for sending a signal to said control means upon detecting such wave motions;

wherein said control means activates said alarm means only upon receiving a signal from said infrared means followed within a defined period of time by a signal from said transducer means.

4. The system of claim 3, wherein said transducer means is an acoustic transducer.

5. A security system for a body of liquid, said system comprising means for presenting an alarm, control means for activating said alarm means, infrared means for detecting the presence of a heat-emitting body approaching said body of liquid, said infrared means sending a signal to said control means upon detecting the presence of such a body, means for detecting wave motions propagated through the liquid by a body in the liquid, said wave motion detecting means sending a signal to said control means upon detecting such wave motions, said control means activating said alarm means only upon receiving signals from both said infrared means and said wave motion detecting means.

6. The system of claim 5, further characterized in that said control means activates said alarm means only when it receives said infrared means signal and said motion detecting means signal within a predetermined period of time.

7. The system of claim 5, further characterized in that said wave motion detecting means is an acoustic transducer.

* * * * *